US005626482A

United States Patent [19]

Chan et al.

[11] Patent Number: 5,626,482

[45] Date of Patent: May 6, 1997

[54] LOW PROFILE SURFACE MOUNTABLE ELECTRICAL CONNECTOR ASSEMBLY

[75] Inventors: Hee C. Chan, Singapore, Singapore; Daniel A. Dixon, Naperville, Ill.; Wee C. Lee, Singapore, Singapore; George M. Simmel, Singapore, Singapore; Wee P. Tay, Singapore, Singapore; Yuen P. Wong, Singapore, Singapore; Khee T. Yeo, Singapore, Singapore

[73] Assignee: Molex Incorporated, Lisle, Ill.

[21] Appl. No.: 356,420

[22] Filed: Dec. 15, 1994

[51] Int. Cl.[6] ..... H01R 9/09

[52] U.S. Cl. ..... 439/74; 439/353; 439/570

[58] Field of Search ..... 439/660, 74, 78, 439/346, 353–357, 570

[56] References Cited

U.S. PATENT DOCUMENTS

| | | | |
|---|---|---|---|
| 4,113,179 | 9/1978 | McKee | 339/91 R |
| 4,734,060 | 3/1988 | Kawawada et al. | 439/600 |
| 4,936,793 | 6/1990 | Uchida | 439/357 |
| 5,167,528 | 12/1992 | Nishiyama et al. | 439/489 |
| 5,181,855 | 1/1993 | Mosquera et al. | 439/74 |
| 5,192,232 | 3/1993 | Lenz et al. | 439/660 |
| 5,224,866 | 7/1993 | Nakamura et al. | 439/81 |
| 5,310,357 | 5/1994 | Olson | 439/346 |

FOREIGN PATENT DOCUMENTS

| | | | |
|---|---|---|---|
| 0280450 | 8/1988 | European Pat. Off. | 439/74 |
| 6111894 | 4/1994 | Japan . | |

*Primary Examiner*—Neil Abrams
*Assistant Examiner*—Eugene G. Byrd
*Attorney, Agent, or Firm*—Stacey E. Caldwell

[57] ABSTRACT

A low profile electrical connector assembly includes plug and receptacle connectors having mating dielectric housings each mounting a plurality of terminals which include contact portions for interengagement with the contact portions of the terminals of the other connector. The terminals include feet portions for surface connection to circuit traces on a pair of printed circuit boards. The terminals are generally U-shaped as defined by a first leg that is joined to the respective foot portion of the terminal and free spring contact leg that is engageable with the contact portion of one of the terminals of the other connector and preloaded on a shoulder of the respective housing. The first leg is fixed to the housing at a proximal end thereof with a distal end of the first leg being flexibly movable into a slot in the housing. A retention member is mounted at each end of each connector housing and is generally L-shaped with a first leg attached to the respective end of one of the housings and second leg adapted for surface securement to the one side of the printed circuit board. Complementary interengaging holding members are provided near the opposite ends of the connector housings for holding the connectors in mated condition.

8 Claims, 4 Drawing Sheets

LOW PROFILE SURFACE MOUNTABLE ELECTRICAL CONNECTOR ASSEMBLY

FIELD OF THE INVENTION

This invention generally relates to the art of electrical connectors and, particularly, to various features of a low profile electrical connector.

BACKGROUND OF THE INVENTION

Miniature or low profile electrical connectors are used extensively in applications wherein it is desirable to maintain the heights of the connectors as short as possible. For instance, miniature or low profile surface mount connectors are mounted on printed circuit boards and the space within an appliance in which the connectors and circuit boards are used is of a premium. The low profile of the connectors cause a variety of problems.

For instance, a problem in low profile surface mount connectors is that the terminals of the connectors have relatively short mating lengths which makes them susceptible to incomplete or partial mating. There is relatively little amount of space or height available to provide for a suitable contact beam length and to yield adequate beam deflection. Furthermore, in board-to-board connector applications wherein no mechanical connections are provided except the frictional engagement between the mating terminals, the possibility that the miniature or low profile connectors can be accidentally unmated by mechanical shock is significant. These considerations have necessitated incorporating either increased frictional engagement between the terminals (thereby increasing the force required to disconnect the connectors) or providing interlocking portions between the mating terminals or the connector housings. Such interlocking portions not only provide positive retention between the mating connectors, but they also can provide tactile feedback or other sensory indication that the connectors are fully mated. Often, however, such interlocking portions between the mating terminals or the connector housings can contribute to complicated molds or dies, and the positive retention can result in excessive mating and unmating forces which, in turn, render the connector and/or the printed circuit board assembly susceptible to damage or breakage upon mating and unmating.

Still further, in surface mount connectors, repeated mating and unmating can compromise the integrity of the solder joints between the surface mount terminals and the circuit traces on the printed circuit board. For this reason, solderable retention members (or "fitting nails") have been used to relieve the stress at the solder joints and to provide additional mechanical joint strength between the connectors and the board so that torsional stresses incurred during mating and unmating are not transferred to the solder joints. The strain relief provided by such solderable retention members is particularly important in connector pairs where the mating and unmating forces are relatively high and/or where the number of circuits is relatively low. However, the provision of adequate retention members or fitting nails in miniature or low profile surface mount connectors can be complicated and costly.

The present invention is directed to providing an electrical connector assembly of the character described above that employs various features that combine to facilitate the miniaturization of the mating connectors and to provide an efficient and very effective low profile connector assembly.

SUMMARY OF THE INVENTION

An object, therefore, of the invention is to provide a new and improved electrical connector assembly that lends itself to miniaturization and a low profile construction.

In the exemplary embodiment of the invention, the low profile electrical connector assembly includes plug and receptacle connectors having mating dielectric housings each mounting a plurality of terminals which include contact portions for interengagement with the contact portions of the terminals of the other connector. The housing of each connector has opposite ends with a mounting face extending therebetween and adapted for surface mounting to one side of a printed circuit board. The terminals include feet portions for surface connection to circuit traces on the printed circuit board. At least one of the terminals of at least one of the connectors includes a generally U-shaped contact portion defined by a first leg that is joined to the respective foot portion of the terminal and a free spring contact leg that is engageable with the contact portion of one of the terminals of the other connector. The first leg is fixed to the housing at a proximal end thereof, with a distal end of the first leg being joined to the free spring contact leg. The first leg is flexibly movable into a slot in the housing.

The connector assembly also includes a retention member mounted at each end of each connector housing for securing the connector to its respective printed circuit board. Each retention member is generally L-shaped, with a first leg attached to the respective end of one of the housings and a second leg for surface securement to the one side of the printed circuit board. The first leg extends substantially transverse to a plane defined by the second leg. Complementary interengaging abutment means are provided between the retention member and the housing extending generally parallel to said plane. As disclosed herein, the abutment means are provided by a pair of oppositely facing ears engageable with a pair of corresponding oppositely facing shoulders on the housing.

The connector assembly further includes complementary interengaging holding members near the opposite ends of the connector housings for holding the connectors in mated condition. The holding members are metal spring members interference fit within internal cavities in the respective connector housings. The metal spring members have cantilevered spring arms facing toward one another upon mating of the connector housings. The holding members include engageable projections which are spaced to allow for limited relative movement in a mating direction of the connector housings in their mated condition.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
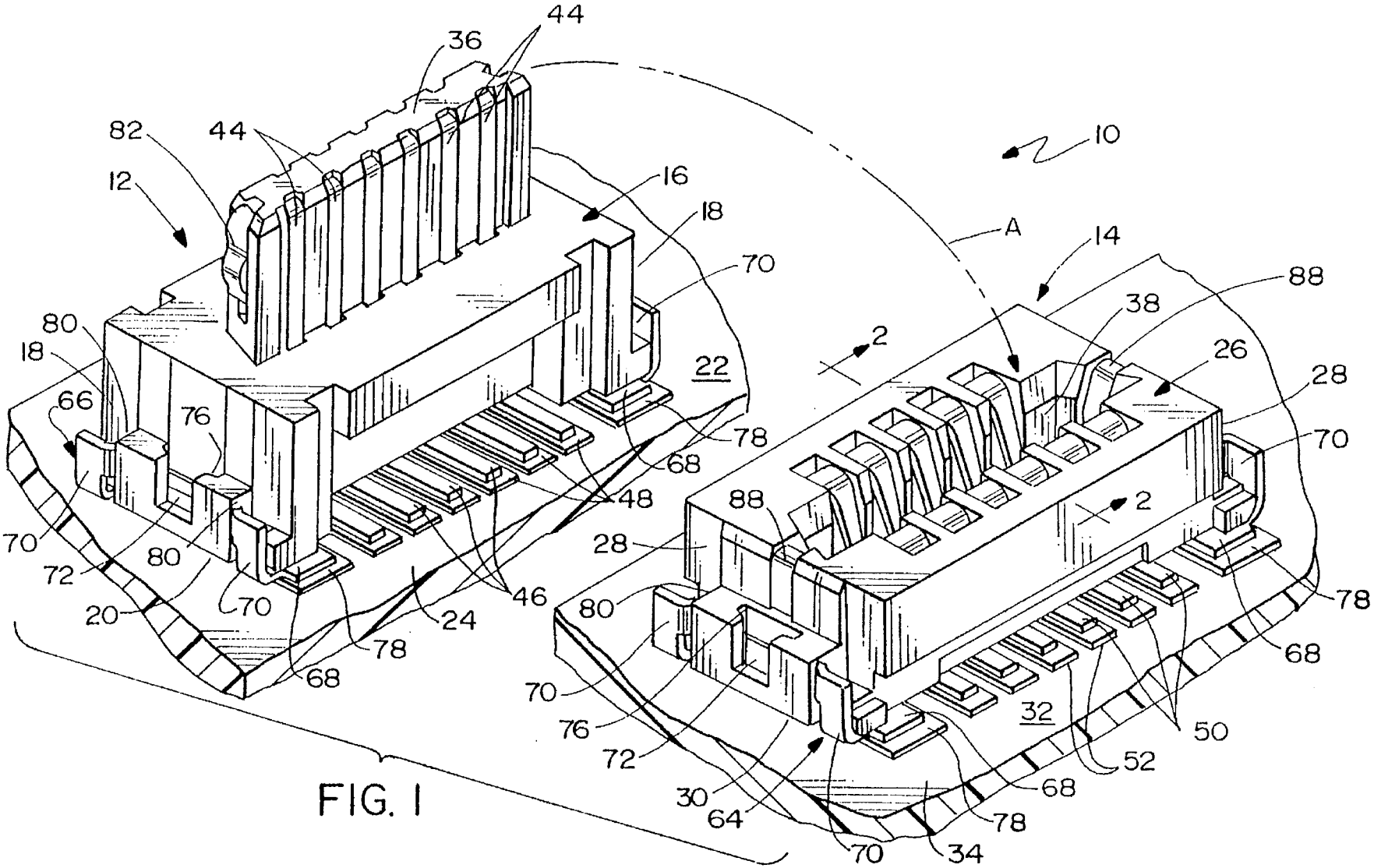
FIG. 1 is an exploded perspective view of the plug and receptacle connectors of the electrical connector assembly of the present invention, in unmated condition.

Referring to the drawings in greater detail, and first to FIG. 1, the invention is embodied in a low profile electrical connector assembly, generally designated 10, which includes a plug connector, generally designated 12, that is mateable with a receptacle connector, generally designated 14. The plug connector includes a dielectric housing, generally designated 16, which has opposite ends 18 with a mounting face 20 extending therebetween and adapted for surface mounting to one side 22 of a printed circuit board 24. Receptacle connector 14 includes a dielectric housing, generally designated 26, that has opposite ends 28 with a mounting face 30 extending therebetween and adapted for surface mounting to one side 32 of a printed circuit board 34.

Figure 2:
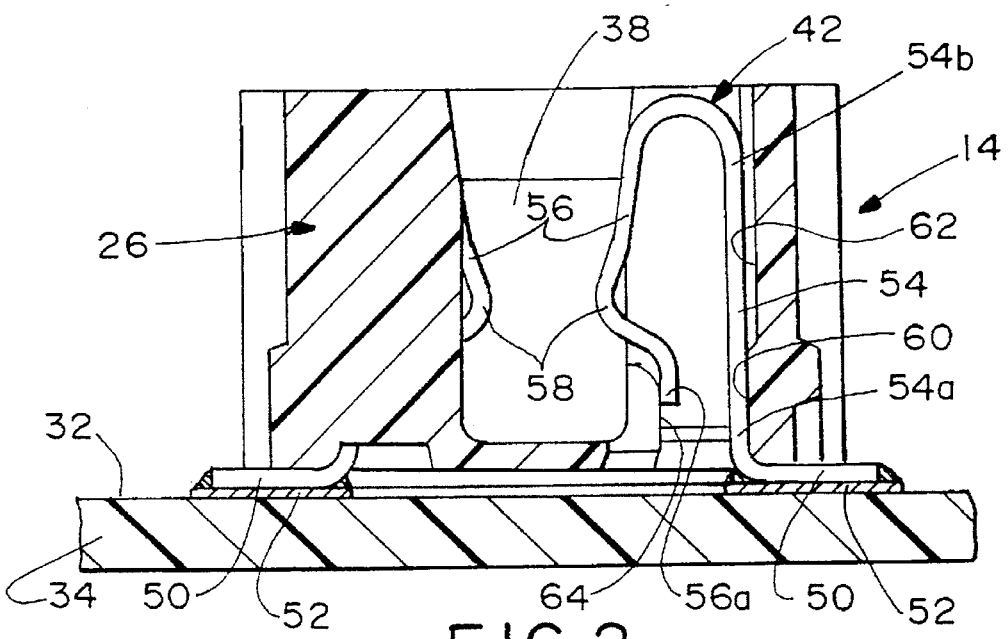
FIG. 2 is a vertical section taken generally along line 2—2 of FIG. 1.
Figure 3:
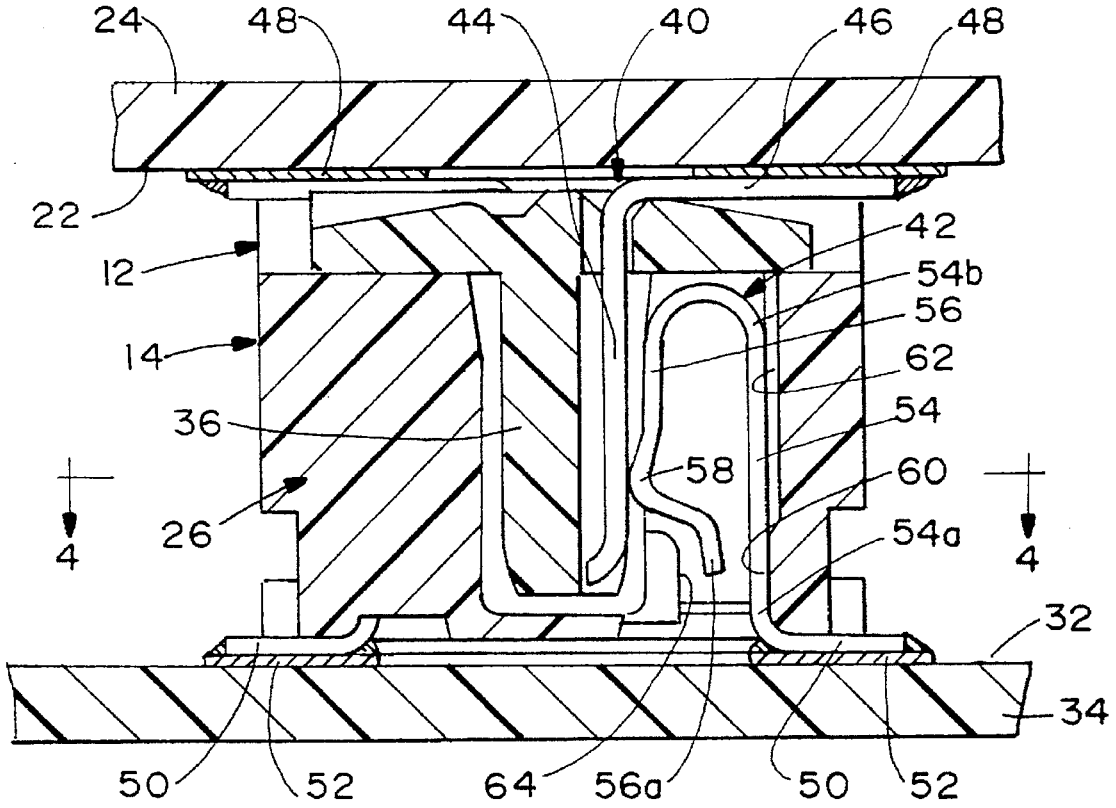
FIG. 3 is a vertical section similar to that of FIG. 2, but of the plug and receptacle connectors in mated condition.

Referring to FIGS. 2 and 3 in conjunction with FIG. 1, plug connector 12 has a plug portion 36 which is mateable in the direction of phantom arrow "A" (FIG. 1) into a receptacle 38 of receptacle connector 14. Plug connector 12 mounts a plurality of terminals, generally designated 40 (FIG. 3), and receptacle connector 14 mounts a plurality of terminals, generally designated 42. As best seen in FIG. 3, terminals 40 of plug connector 12 include blade-like contact portions 44 (also see FIG. 1) exposed on the sides of plug portion 36 and feet portions 46 for surface connection to circuit traces 48 on side 22 of printed circuit board 24. In essence, terminals 40 of plug connector 12 are L-shaped and are disposed on opposite sides of plug portion 36 of the connector housing 16. The connector housing is unitarily molded of a dielectric material, such as plastic or the like, and the terminals are stamped and formed of electrically conductive sheet metal material.

Terminals 42 of receptacle connector 14 are located on opposite sides of receptacle 38. Each terminal 42 has a foot portion 50 for surface connection to a respective circuit trace 52 on side 32 of printed circuit board 34. Each terminal 42 includes a generally U-shaped contact portion defined by a first leg 54 that is joined to foot portion 50 and a free spring contact leg 56 that includes a rounded contact portion 58 that is engageable with the contact portion 44 of a respective plug connector terminal 40 as shown in FIG. 3. In essence, first leg 54 has a proximal end **54*a* that is fixed against a wall 60 (FIGS. 2 and 3) of receptacle connector housing 26 and a distal end 54*b* that is flexibly movable into a slot 62 in housing 26. Therefore, the entire U-shaped contact portion of terminal 42, including legs 54 and 56, is flexible about fixed proximal end 54*a* of leg 54. This allows for considerable flexibility and consequent deflection characteristics in the terminal, notwithstanding its short beam length due to the low profile of receptacle connector 14. Like housing 16 and terminals 40 of plug connector 12, housing 26 is unitarily molded of a dielectric material, such as plastic or the like, and terminals 42** are stamped and formed of electrically conductive sheet metal material.

Still referring to FIGS. 2 and 3, it can be seen that terminals 42 are "preloaded" within their respective terminal cavities in receptacle connector housing 26. In particular, it can be seen in FIG. 2 that a distal end **56*a* of leg 56 is spring loaded or biased against a shoulder 64 of housing 26. When the connectors are mated as shown in FIG. 3, it can be seen that the distal end 56*a* of leg 56 has moved off of shoulder 64**. Such preloading allows minimal deflection of the terminal since the beam length is shortened, while still providing adequate normal forces between the mating terminals during mating of the connectors.

Figure 5:
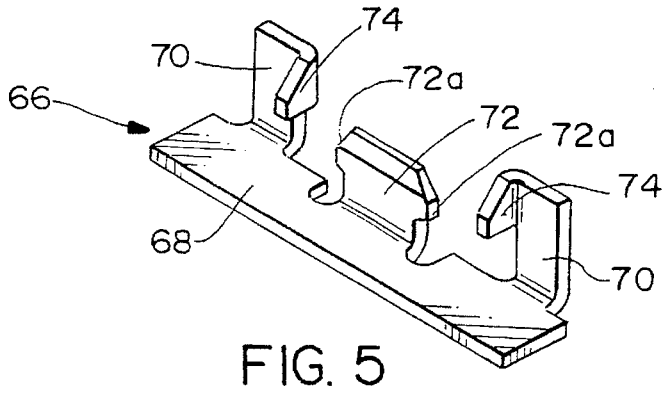
FIG. 5 is a perspective of one of the retention members.

Generally, low profile electrical connector assembly 10 includes a retention system for securely retaining plug and receptacle connectors 12 and 14, respectively, to their respective printed circuit boards 24 and 34. More particularly, FIG. 5 shows a retention member, generally designated 66, that, as will be described below, is mounted at each end of each connector housing 16 and 26. More particularly, each retention member 66 is generally L-shaped with a generally planar leg 68 that is adapted for surface securement to the respective printed circuit board. Another leg of the L-shaped configuration is defined by outside arms 70 which are located on opposite sides of an inside arm 72. The inside arm has a pair of edge portions 72 for purposes described hereinafter. Outside arms 70 have inner, oppositely facing ears 74, again for purposes described hereinafter.

Figure 4:
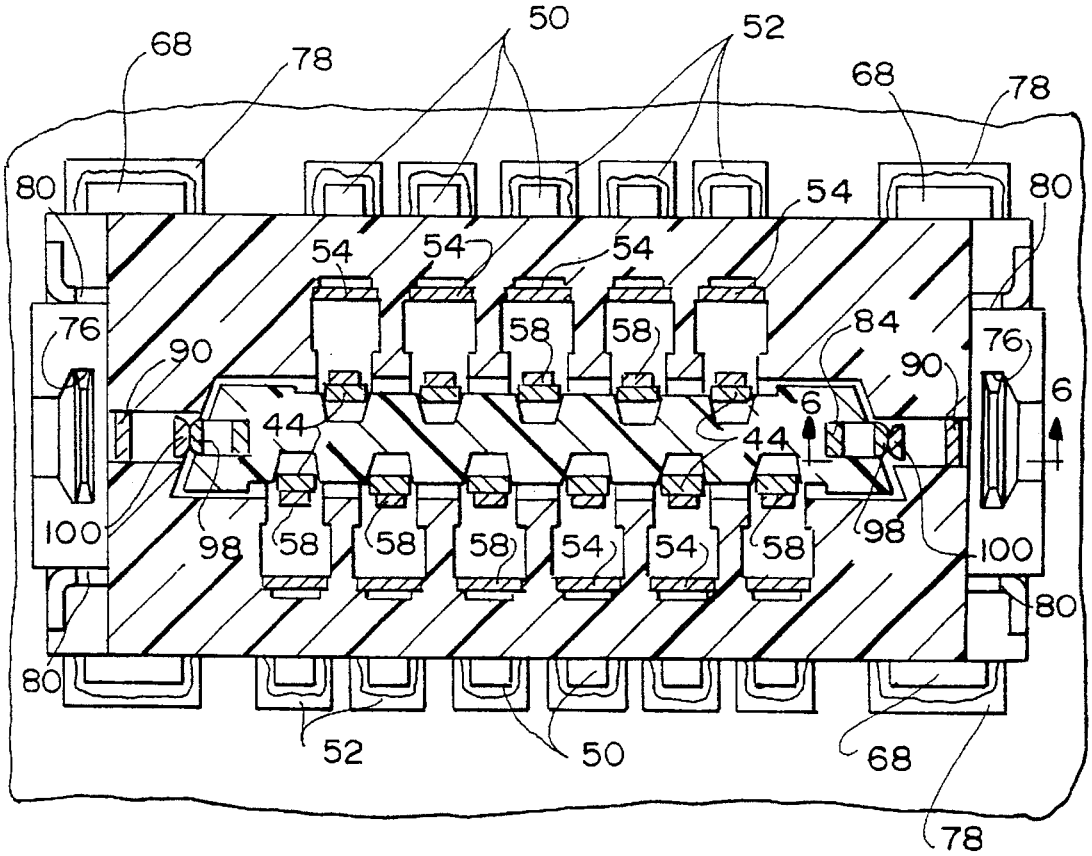
FIG. 4 is a horizontal section taken generally along line 4—4 of FIG. 3.

Referring to FIGS. 1, 4 and 5, one of the retention members 66 (FIG. 5) is mounted at each end 18 of plug connector housing 16 as well as at each end 28 of receptacle connector housing 26. Inside arms 72, and particularly edge portions **72*a*, of retention members 66 are inference fit into passages 76 in the respective housings, through the respective mounting faces 20 and 30 thereof, to securely fix the retention members in the housings. Legs 68 of the retention members are surface secured, as by soldering, to enlarged solder pads 78 on the printed circuit boards to provide additional retention of the surface mount plug and receptacle connector to their respective circuit boards. Furthermore, in order to reinforce the connector housings in directions transverse to the plane of the circuit board 24, oppositely facing ears 74 of the retention members abut against oppositely facing shoulders 80 of the respective connector housings. Since each retention member 66** is stamped and formed of sheet metal material, the retention members may be soldered to the grounding circuit of the respective printed circuit board, as will be described below.

A further feature of the low profile surface mount mating connectors, complementary interengaging holding members are provided near opposite ends of connector housings 16 and 26 of plug connector 12 and receptacle connector 14, respectively, for removably retaining the connectors in mated condition. More particularly, referring to FIGS. 6 and 7 in conjunction with FIG. 1, a holding member, generally designated 82, is generally U-shaped and includes a first leg 84 interference fit within a cavity 86 near the end of housing 16 of plug connector 12. Similarly, a holding member, generally designated 88, is generally U-shaped and includes a first leg 90 which is interference fit within an internal cavity 92 near the end of housing 26 of receptacle connector 14. Holding member 82 includes a cantilevered free spring arm 94, and holding member 88 includes a cantilevered free spring arm 96, the free spring arms of the holding members facing toward one another upon mating of the connectors 12 and 14. Free spring arm 94 of holding member 82 includes a radiused projection 98, and free spring arm 96 of holding member 88 includes a radiused projection 100. When plug and receptacle connectors 12 and 14 are mated, radiused projections 98 and 100 of holding members 82 and 88, respectively, override each other to the positions shown in FIG. 6. The holding members thereby removably retain the connectors in mated condition. In addition, the holding members are stamped and formed of sheet metal material whereby, during mating of connectors 12 and 14, the radiused projections give a tactile or audible indication that the connectors are mated.

Furthermore, since the holding members are electrically conductive, they can, either individually or with a respective retention member, be electrically connected to the respective ground circuit of the underlying printed circuit board. This is to say, plug and receptacle connectors 12 and 14 can be grounded to one another, and the grounding circuits of their respective circuit boards coupled, through holding members 82 and 88, respectively, by extending first legs 84 and 90 of holding members 82 and 88 through their respective housings 16 and 26 to contact the grounding circuit on the surface of underlying circuit boards 24 and 34. Alternatively, a portion of the holding members such as the first legs can be formed integrally with or partially engage the retention members 66 which themselves can be soldered to an underlying grounding circuit.

Figure 7:
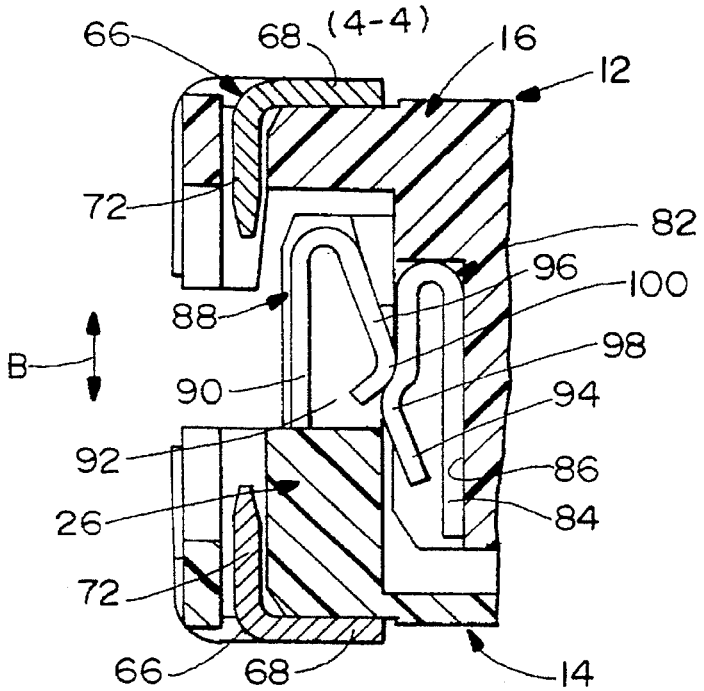
FIG. 7 is a view similar to that of FIG. 6, but with the connectors slightly moved relative to each other in the mating direction.
Figure 6:
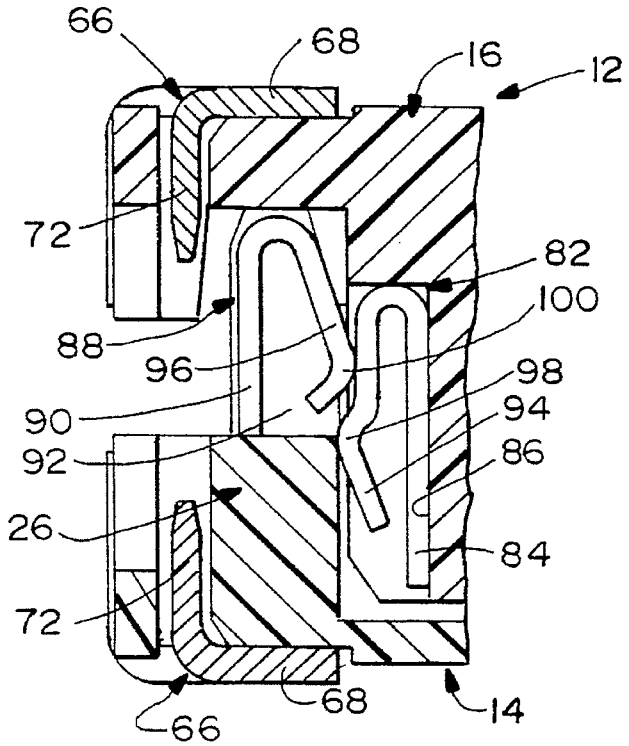
FIG. 6 is a fragmented vertical section taken generally along line 6—6 of FIG. 4.

Lastly, in comparing FIG. 6 with FIG. 7, it can be seen that the radiused projections 98 and 100 of holding members 82 and 88 are configured to allow for relative movement of the connectors in a mating direction when in their mated condition, as indicated by double-headed arrow "B" in FIG. 7. This allows for the connectors to be unmated in a form of "zippering" action, i.e one end of the connector to be grabbed first so that the other end is unmated last, without damaging the connectors or the terminals. Furthermore, the normal forces exerted by the free spring arms 94 and 96 and their respective radiused projections 98 and 100 act in the axial or end-to-end direction of the connectors (i.e. in a direction transverse to the terminal contact forces) and, therefore, no additional unbalanced loads are placed on the terminals. This becomes important in connector configurations where a different amount of terminals are used on opposite sides of the longitudinal centerline of the connector, as shown in FIG. 1 wherein five terminals are on one side, and six terminals on the other side of the longitudinal centerline of connectors 12 and 14.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector assembly, comprising:

plug and receptacle connectors having mating dielectric housings each mounting a plurality of terminals which include contact portions for interengagement with the contact portions of the terminals of the other connector, the housing of each connector having opposite ends with a mounting face extending therebetween and adapted for surface mounting to one side of a printed circuit board, the terminals including feet portions for surface connection to circuit traces on the board;

at least one of the terminals of at least one of the connectors including a generally U-shaped contact portion defined by a first leg that is joined to the respective foot portion of the terminal and a free spring contact leg that is engageable with the contact portion of one of the terminals of the other connector, the first leg being fixed to the housing at a proximal end thereof with a distal end of the first leg being joined to said free spring contact leg;

a stamped and formed retention member mounted at each end of each connector housing for securing the connector to its respective printed circuit board, each retention member being generally L-shaped with a first leg attached to the respective end of one of the housings and a second leg adapted for surface securement to said one side of the printed circuit board; and complementary interengaging metal spring members near the opposite ends of the connector housings for holding the connectors in mated condition, wherein said metal spring members are interference fit within corresponding cavities in the respective connector housings.

2. The electrical connector assembly of claim 1 wherein each metal spring member includes a cantilevered spring arm adapted to deflect and removably lock to an oppositely directed spring member when the connector housings are in the mated condition.

3. The electrical connector assembly of claim 1 wherein said metal spring members include engageable detents which are contoured to allow for limited relative movement of the connector housings when in the mated condition.

4. An electrical connector assembly, comprising:

a plug and receptacle connector having mating dielectric housings each mounting a plurality of terminals which include contact portions for interengagement with the contact portions of the terminals of the other connector, the housing of each connector having opposite ends with a mounting face extending therebetween and adapted for surface mounting to one side of a printed circuit board, and the terminals including feet portions for surface connection to circuit traces on the board;

the terminals of one of the connectors each including a generally U-shaped contact portion defined by a first leg joined to the respective foot portion of the terminal and a free spring contact leg engageable with the contact portion of one of the terminals of the other connector, the first leg being fixed to the housing at a proximal end thereof with a distal end of the first leg being joined to said free spring contact leg; and a retention member mounted on at least one of the opposite ends of the connector housings, the retention member being generally L-shaped and including a first leg attached to at least one of the ends of the housing and a second leg, generally perpendicular to the first leg, extending substantially entirely across the one end of the connector housing and adapted for surface securement to said one side of the printed circuit board, the first leg of the retention member further including an inside arm having edge portions which provide an interference fit within the one end of the connector housing.

5. The electrical connector assembly of claim 4 wherein the first leg of the retention member further includes oppositely facing ears on either side of the inside arm which engage corresponding shoulders on the housing.

6. An electrical connector assembly, comprising:

a plug and receptacle connector having mating dielectric housings each mounting a plurality of terminals which include contact portions for interengagement with the contact portions of the terminals of the other connector, the housing of each connector having opposite ends with a mounting face extending therebetween adapted for surface mounting to one side of a printed circuit board, the terminals including feet portions for surface connection to circuit traces on the board; and the terminals of one of the connectors each including a generally U-shaped contact portion defined by a first leg joined to the respective foot portion of the terminal and a free spring contact leg engageable with the contact portion of one of the terminals of the other connector, the first leg being fixed to the housing at a proximal end thereof with a distal end of the first leg being joined to said free spring contact leg;

wherein each terminal cavity of one of the housings includes a preload shoulder engageable by a distal end of the free spring contact leg of its respective terminal to preload the terminal within its terminal cavity to provide relatively high normal forces with minimal deflection of the free spring contact leg.

7. The electrical connector assembly of claim 6 further including at least one generally L-shaped retention member mounted on at least one of the opposite ends of the connector housings, the retention member including a first leg attached to the housing, and a second leg, generally perpendicular to the first leg, adapted for mounting to the surface of said one side of the printed circuit board, wherein the second leg extends substantially entirely across the end of the connector.

8. The connector assembly of claim 7 wherein the first leg of the retention member further includes an inside arm having edge portions which provide an interference fit within the end of the housing and oppositely facing ears on either side of the inside arm adapted to engage corresponding shoulders of the housing.

* * * * *